US008833387B2

(12) United States Patent
Lucas et al.

(10) Patent No.: US 8,833,387 B2
(45) Date of Patent: Sep. 16, 2014

(54) FLOOR DRAIN WITH DETACHABLE COVER AND METHOD OF USING

(71) Applicants: Timothy Lucas, Melbourne (AU); Kent Charles Curley, Salinas, CA (US)

(72) Inventors: Timothy Lucas, Melbourne (AU); Kent Charles Curley, Salinas, CA (US)

( * ) Notice: Subject to any disclaimer, the term of this patent is extended or adjusted under 35 U.S.C. 154(b) by 192 days.

(21) Appl. No.: 13/694,239

(22) Filed: Nov. 10, 2012

(65) Prior Publication Data

US 2014/0130902 A1 May 15, 2014

(51) Int. Cl.
*A47K 3/00* (2006.01)
*E03F 5/04* (2006.01)

(52) U.S. Cl.
CPC ..... *E03F 5/0407* (2013.01); *E03F 5/0408* (2013.01)
USPC ..... 137/362; 4/613

(58) Field of Classification Search
USPC ..... 137/362; 4/613
See application file for complete search history.

(56) References Cited

U.S. PATENT DOCUMENTS

| | | | | |
|---|---|---|---|---|
| 2,836,830 | A | 6/1958 | Norman | |
| 4,541,132 | A | 9/1985 | Long | |
| 5,458,769 | A | 10/1995 | Johannessen | |
| 6,003,169 | A | 12/1999 | Davis | |
| 7,617,644 | B2 | 11/2009 | Nielsen | |
| 2008/0222797 | A1 * | 9/2008 | Cook | 4/613 |
| 2008/0277324 | A1 | 11/2008 | Meyers | |
| 2010/0043136 | A1 | 2/2010 | Michael | |

* cited by examiner

*Primary Examiner* — John K Fristoe, Jr.
*Assistant Examiner* — Kevin E Lynn

(57) ABSTRACT

A floor drain having a drainage gutter and a detachable cover that is firmly attached to the floor drain and configured to hold a tile that complements or accents the tile in the shower, the surrounding floor, or the floor plane.

20 Claims, 14 Drawing Sheets

FLOOR DRAIN WITH DETACHABLE COVER AND METHOD OF USING

FEDERALLY SPONSORED RESEARCH

Not Applicable

SEQUENCE LISTING OR PROGRAM

Not Applicable

FIELD OF THE INVENTION

This invention relates generally to floor drains of the type typically found in tiled showers. More specifically, this invention relates to a generally rectangular floor drain typically found in showers but may also be found in bathroom floors, kitchen floors, outside floors, or any such location where drainage is required in the floor plane, said drain having a drainage gutter and a detachable cover that is firmly attached to the floor drain and configured to hold a tile that complements or accents the tile in the shower or the floor plan as described above.

BACKGROUND OF THE INVENTION

Description of Prior Art

Floor drains for showers and the like have existed for centuries. While the first floor drains were simply holes in the floor, aesthetics, safety concerns, and building codes have mandated the design and development of floor drains that are typically covered by some sort of protective device or strainer. One large family of such devices consists of what are known as top-mounted strainers which are simply mounted on top of the building material surrounding the (generally) circular drainage hole on the shower stall. While functional and relatively inexpensive, these types of drains are not particularly appealing aesthetically. Further, the fact that they protrude above the surface of the floor gives rise to a comfort issue, especially if the strainer is rectangular in shape. Further still, top-mounted strainers are either screwed into place or snapped into place with some type of locking mechanism which makes them difficult to remove for routine maintenance and/or cleaning. Finally, top-mounted strainers tend to be relatively thin and will eventually deform over time which as to the hazard exposed edges present to the user's bare feet.

To address these issues, plumbing fixture designers introduced flush-mounted drains. These drains have grates or strainers that are flush with the building material surrounding the drainage hole and typically have a grout rim feature that is fabricated from the same material as the grate/strainer or from the same material as the drain itself. However, both grout rim designs present additional problems. The exposed drain option results in having two different materials side-by-side (unless the drain and the grate/strainer are made of the same material which is generally not the case) which is awkward from an aesthetic perspective. Further, the very nature of grout rims is that they are part of the drain structure itself that must be bonded into the flooring materials surrounding the drain itself. As such, they cannot be removed.

Both of the foregoing strainer/grate families had other aesthetic limitations as well. The nature and function of both top-mounted strainers and flush-mounted strainers made them suitable fixtures for the previous standard composition choices for plumbing fixtures: brass or chrome. Modern designs, however, offer the consuming public a much wider selection of materials and finishes that would likely present problems if they were used in the top-mounted strainers or flush-mounted strainers typically used in the building trades industry. More modern finishes tend to be more delicate and they would likely be subjected to significant damage, corrosion, and the like if they were used for grate/strainers of the type previously discussed. The need for additional maintenance or cleaning and the difficulty in removing these strainers/grates would become a labor-intensive issue, especially if these grates/strainers were installed in a commercial building such as a hotel or spa.

The prior art contains numerous examples of devices and methods that address these problems. By way of example, the following prior art examples disclose innovative and aesthetic devices:

U.S. Pat. No. 2,836,830 issued to Norman (1958) discloses a tile receptor for showers having a sloping floor surface with tiles embedded therein. The device disclosed by Norman is essentially the floor of the shower stall into which smaller tiles are embedded. Similarly, U.S. Pat. No. 4,541,132 issued to Long (1985) discloses a shower pan which, like the device disclosed by Norman, forms the base (or floor) of a shower stall. The invention disclosed by Long is permanently mounted on graduated shims to provide a graduated, sloping surface.

U.S. Pat. No. 5,458,769 issued to Johannessen (1995) discloses a floor drain with a "bell" covering the drainage bowl. The device covering the drainage hole can be turned upward so as to have the stainless steel side exposed or turned upside down (in comparison with the bell of the first embodiment) so as to appear as a bowl. This bowl may be filled with the same material from which the surrounding floor is made. Johannessen goes on to disclose a permanently attached (welded) bell in the embodiment shown in FIGS. 11 and 12.

U.S. Design Pat. No. D 602,575 issued to Breda (2009) discloses five embodiments of a shower strainer having a square, flat-topped shower strainer cap fitting into and supported by a strainer adaptor. The underside of the strainer cap and the upper side of the strainer adaptor have vertical appendages extending outward from each surface that appear to loosely fit into each other.

U.S. Pat. No. 6,003,169 issued to Davis, Jr. (1999) discloses a solid surface shower pan that, like the devices disclosed by Norman and Long, forms the base (or floor) of a shower stall. The invention disclosed by Davis is permanently mounted to provide a graduated, sloping surface.

U.S. Pat. No. 7,617,644 issued to Nielsen (2009) discloses a drain and a building having a drain. Nielsen discloses a drain whereby the drain cap is a perforated flat surface resting on ledges set in a metallic frame and the water drains through the perforations.

U.S. Patent Publication No. 2008/0222797 (Cook 2008) discloses a prefabricated shower pan having varying sidewall heights and a method of attaching a modular curb thereto. Cook, like Norman, Long, and Davis, discloses a solid surface shower pan that like the devices discussed previously, forms the base (or floor) of a shower stall. The invention disclosed by Cook is permanently mounted to provide a graduated, sloping surface.

U.S. Patent Publication No. 2008/0277324 (Meyers 2008) discloses a floor drain having a generally rectangular drain grate with a plurality of drain holes. The water drains through the perforations.

U.S. Patent Publication No. 2010/0043136 (Michael 2010) discloses a shower pan drain assembly that is an integrated shower base designed for improving the drainage of a tiled shower stall/bottom. The drain is permanently welded to floor pan.

As mentioned previously, these devices greatly increased the efficiency and durability of the strainers, grates, and drains made available to consumers. What's more, these devices provided the user a wider assortment of aesthetically pleasing choices of building materials and finishes. However, some issues persisted despite the combined creativity and ingenuity disclosed by the prior art. What's more, some of the solutions to the foregoing problems introduced new problems because of the design and/or construction of these devices.

By way of example, many drain strainers or grates are still mounted with screws or locking devices that makes them difficult to remove for routine inspection, maintenance, and cleaning or replacement as the case may be. This is particularly problematic for drains installed in commercial building such as hotels, spas, athletic facilities, and the like. Those devices that are not mounted with screws or locking devices tend to slip or slide in place when someone walks on them giving rise to another potential safety hazard. Furthermore, many if the devices disclosed by the prior art are quite complex or have numerous fittings or fixtures therein making them cumbersome and difficult to install. This complexity also makes them expensive to manufacture which means they will be more expensive to the consumer.

Objects and Advantages

The present invention has been designed to address the foregoing problems found in the prior art. Accordingly, the objects and advantages of the present invention are:

(1) To provide a floor drain having a detachable cover that is securely attached to its foundation but easily removed so as to permit easy inspection, cleaning, or other such routine maintenance of the drain.

(2) To provide a floor drain having a detachable cover that affords the user an unlimited number of options as to materials to place in the cover itself.

(3) To provide a floor drain having a detachable cover that is simple in design, easy and inexpensive to manufacture, and reasonable in cost to the consumer.

(4) To provide a floor drain having a detachable cover that is securely attached to its foundation so that it does not move, slip, or slide when the user steps on it.

Further objects and advantages of the present invention will become apparent from a consideration of the drawings and the ensuing description of the invention.

DRAWINGS

Drawing Figures

REFERENCE NUMERALS IN DRAWINGS

10—Floor or shower drain
11—Drainage channel
20—Detachable Insert
21—Bottom
211—Underside
22—Side
221—Inside Face of Detachable Insert Side
222—Outside Face of Detachable Insert Side
23—Groove
24—Drainage Hole
25—Securing Wedge
251—Inner Surface
252—Outer Surface
30—Base
31—Base Bottom
311—Outer Extremity of Base Bottom
32—Base Side
321—Inside Face of Base Side
322—Outside Face of Base Side
33—Drain Hole
331—Drain-Hole Side
332—Metal Tab
333—Set Screw
34—Support Post Footing
341—Support Post Footing Hole
342—Support Post Footing Top Surface
343—Support Post Footing Bottom Surface
35—Support Post
351—Support Post Hole
352—Support Post Side
36—Screw

DETAILED DESCRIPTION

Description—Preferred Embodiment

Figure 1:
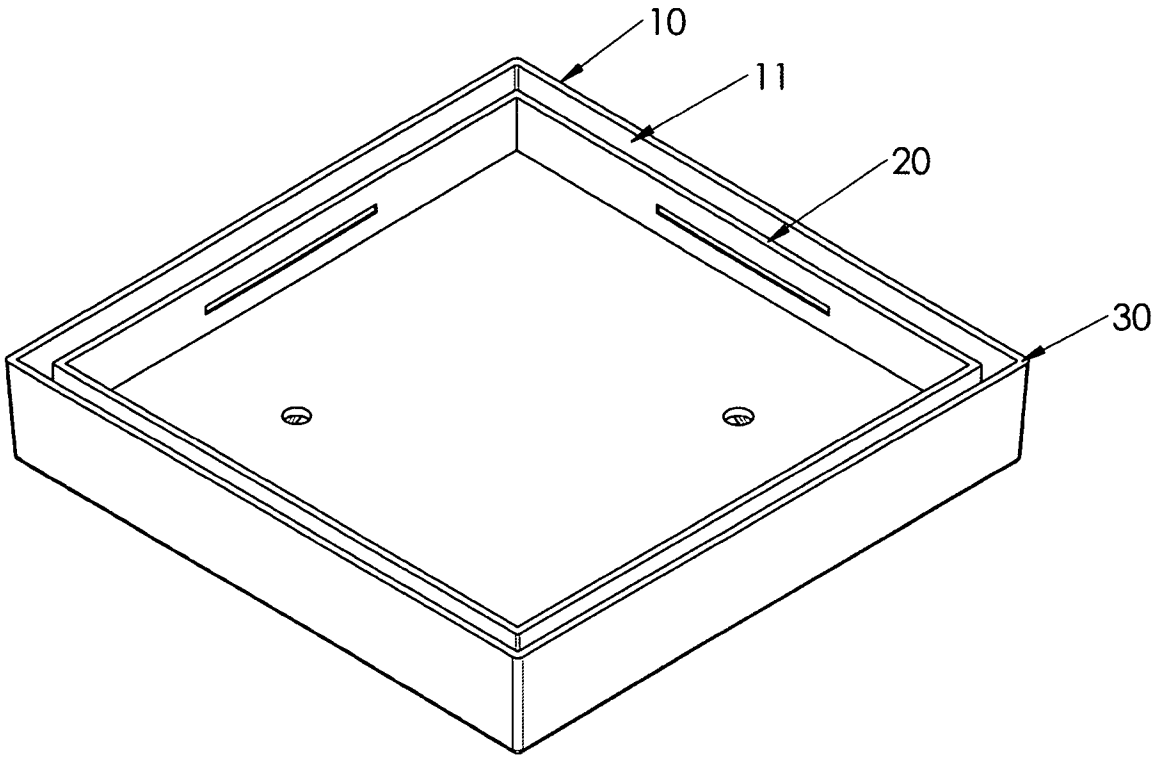
FIG. 1 is a perspective view of the present invention
Figure 2:
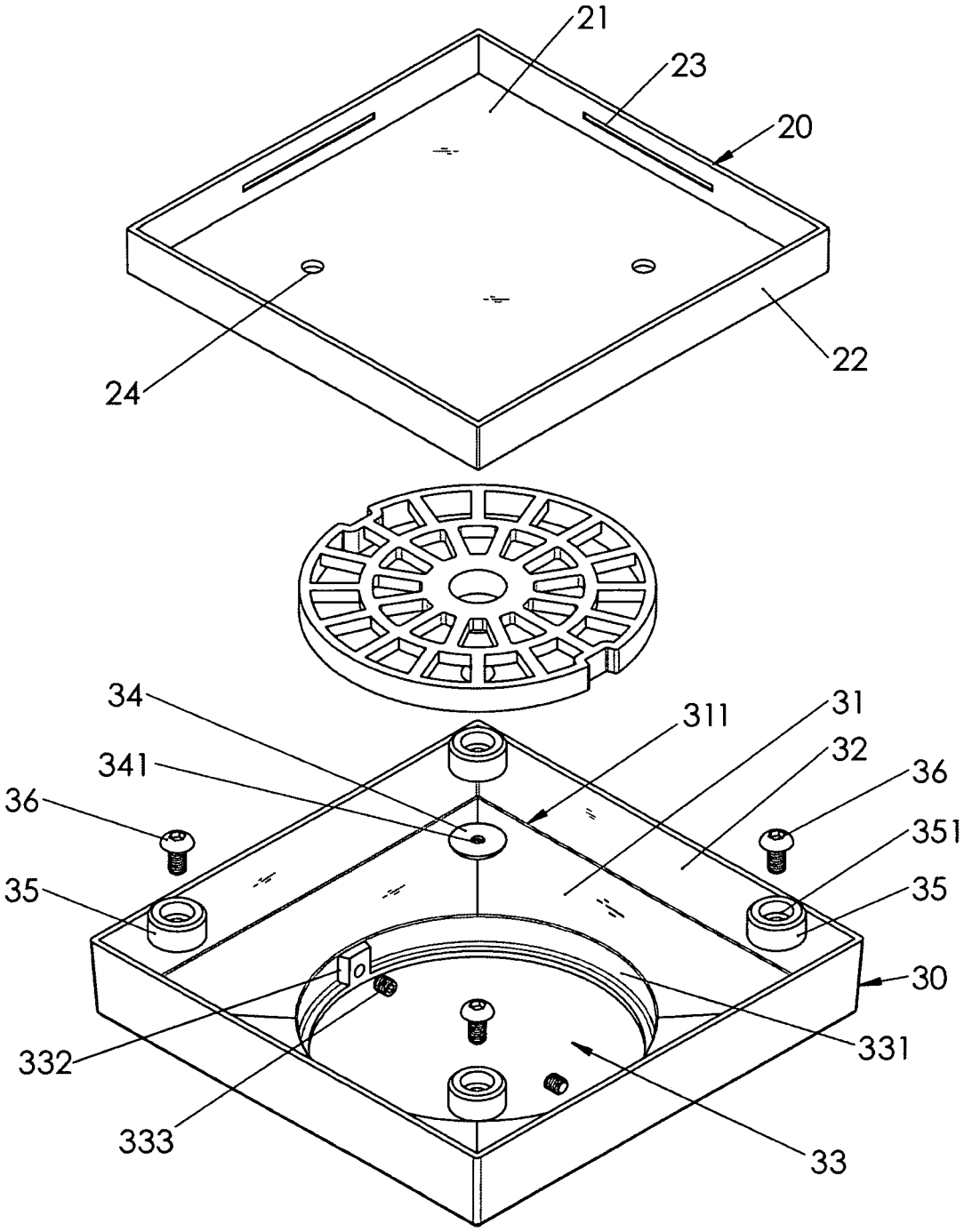
FIG. 2 is an exploded perspective view of the present invention

FIG. 1 shows a perspective view of the preferred embodiment of the present invention while FIG. 2 shows an exploded perspective view of the preferred embodiment of the present invention. Referring to FIG. 1, the floor or shower drain (10) is comprised of a generally rectangular-shaped detachable insert (20) that fits into a generally rectangular-shaped base (30) of slightly greater linear dimensions so as to create a drainage channel (11) between the sides of the detachable insert (20) and the base (30). While the rectangular shape of the drain (10) is the most common shape, other geometric shapes are contemplated as well including, without limitation, circular, elliptical, triangular, and the like. In all embodiments, the same general configuration of a detachable insert (20) fitting into a similarly-shaped base (30) of slightly larger linear dimensions is contemplated. The drain (10) is typically comprised of non-corrosive and/or non-reactive metals such as plated brass or stainless steel but any suitable non-corrosive and/or non-reactive material that meets respective local and/or national building codes would be an appropriate substitute.

Referring to FIG. 2, the detachable insert (20) of the preferred embodiment is cast or fabricated with a generally rectangular box-like shape that is open at the top. Again, the detachable insert (20) can be cast or molded in any number of geometrical shapes but the generally rectangular shape is the most common. Accordingly, the detachable insert (20) has a flat and generally rectangular bottom (21) and four sides (22) extending perpendicularly upward from the outer extremities of the bottom (21) so as to create a boxlike container or tray which can securely hold a typical, commercially-available, decorative ceramic floor tile, concrete, epoxy composite, or other appropriate floor material. A horizontal groove (23) is centered on the inside face (221) of each side (22) of the detachable insert (20). The groove (23) may be cast when the sides (22) are formed or they may be machined or gouged out after the sides (22) have been cast. Each groove (23) extends inwardly into the inside face (221) to facilitate securing grout that is placed around a decorative tile placed into the detachable insert (20). One or more drainage holes (24) are located in the bottom (21) to permit drainage of any water falling into the detachable insert (20) and seeping under a decorative tile placed therein. Preferably, the detachable insert (20) is uniformly cast or stamped but the sides (22) can be attached to the bottom (21) by welding, gluing, or any other suitable process for joining materials.

Still referring to FIG. 2, the detachable insert (20) fits into a similarly-shaped base (30) that is slightly larger in its linear dimensions. The base (30) also has a generally rectangular bottom (31) but the bottom (31) of the base (30) slopes downward away from the outer extremities (311) of the bottom (31) and toward the center of the bottom (31). Four sides (32) extend perpendicularly upward from the outer extremities of the bottom (31) so as to create a boxlike container into which the detachable insert (20) will fit. A large, generally circular drainage hole (33) is centered in the middle of the bottom (31) and thereby marks the end of the downward slope of the bottom (31) from its outer extremities (311). The bottom (31) intersects the drainage-hole sides (331) which define the drainage hole (33) and extend vertically downward from the bottom (31). Two metal tabs (332) are positioned opposite each other on the drainage-hole side (331) to permit attaching the drain assembly (10) to a waste water pipe (not shown) with set screws (333) passing through the waste water pipe and screwing into the metal tabs (332). The metal tabs (332) are typically shaped like a truncated pyramid and protrude perpendicularly from the drainage-hole side (331) into the drainage hole (33).

Four cylindrical support post footings (34) each with a hole (341) drilled through its center are positioned near the four outermost corners of the bottom (31). The support post footing hole (341) is threaded to receive and hold a commercially available metal screw. The detachable insert (20) rests upon four cylindrical support posts (35) each with a hole (351) drilled through its center. In turn, the support posts (35) rest upon the support post footings (34) so their respective holes (351 and 341) are aligned, one atop the other. The support post footings (34) are typically comprised of the same material as the bottom (31) and may be uniformly cast with the bottom (31) or cast separately and then attached to the bottom (31) by welding, gluing, or any other suitable process for joining materials. The support posts (35) are typically comprised of a material that is softer than that comprising the detachable insert (20), the base (30), and the support post footings (34). Each support post (35) is secured to its respective support post footing (34) and thereby, the base (30), by a screw (36) inserted through the support post hole (351) and the support post footing hole (341) which is threaded to accommodate the threading of the screw (36). The diameter of the support post hole (351) is larger near the top of support post hole (351) to accommodate the head of the screw (36) so that the screw (36) does not extend above the top of the support post (35).

As mentioned previously, the linear dimensions of the detachable insert (20) are smaller than those of the base (30) thereby giving rise to a space between the sides (22) of the detachable insert (20) and the sides (32) of the base (30). Similarly, the bottom (21) of the detachable insert (20) rests upon four support posts (35) which sit atop four support post fillings (34) thereby giving rise to another space between the bottom (21) of the detachable insert (20) and the bottom (31) of the base (30). These spaces create a drainage channel (11) which provides any water reaching the drain (10) with an exit route to the drainage hole (33) located in the bottom (31) of the base (30) but hidden from view by the detachable insert (20). Such a configuration provides the user with a functioning floor or shower drain (10) that is more attractive than the industry-standard, visible hole in the floor with a grating inserted over it.

Figure 3:
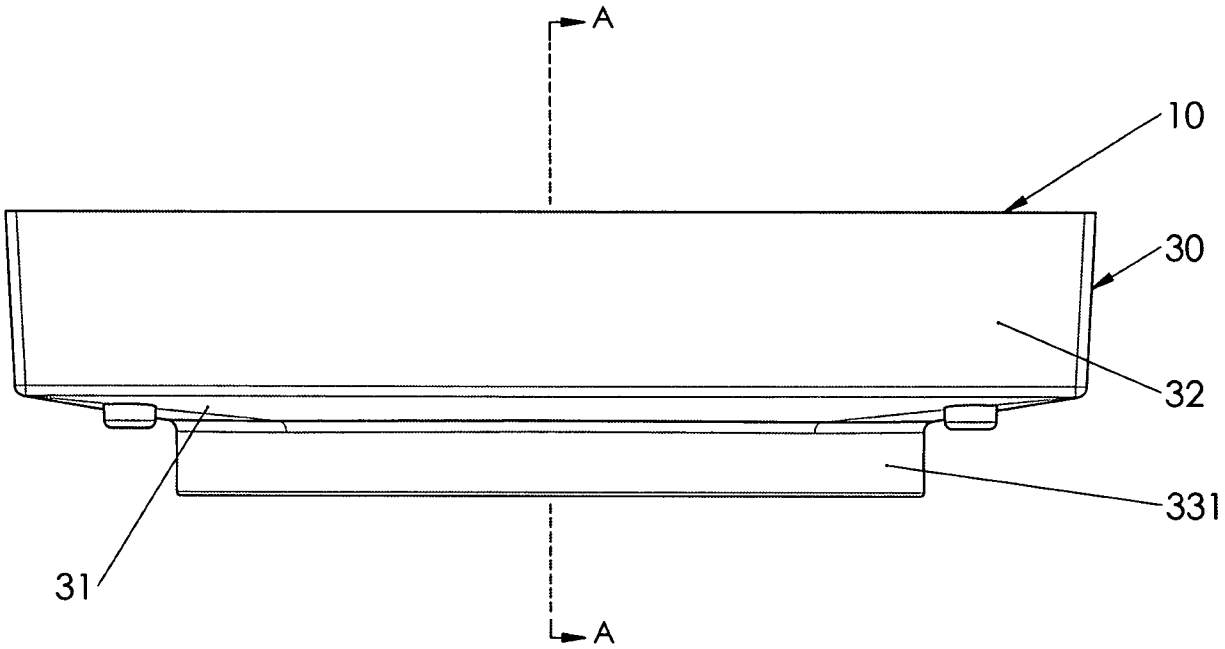
FIG. 3 is a side view of the present invention

FIG. 3 is a side view of the present invention which shows how the bottom (31) of the base (30) slopes downward to intersect with a cylindrical drainage hole side (331) which extends perpendicularly downward from the edges of the drainage hole (33). The drainage hole side (331) can be smooth or grooved to fit into a standard drainage pipe (not shown) leading to the building's waste water system.

Figure 4:
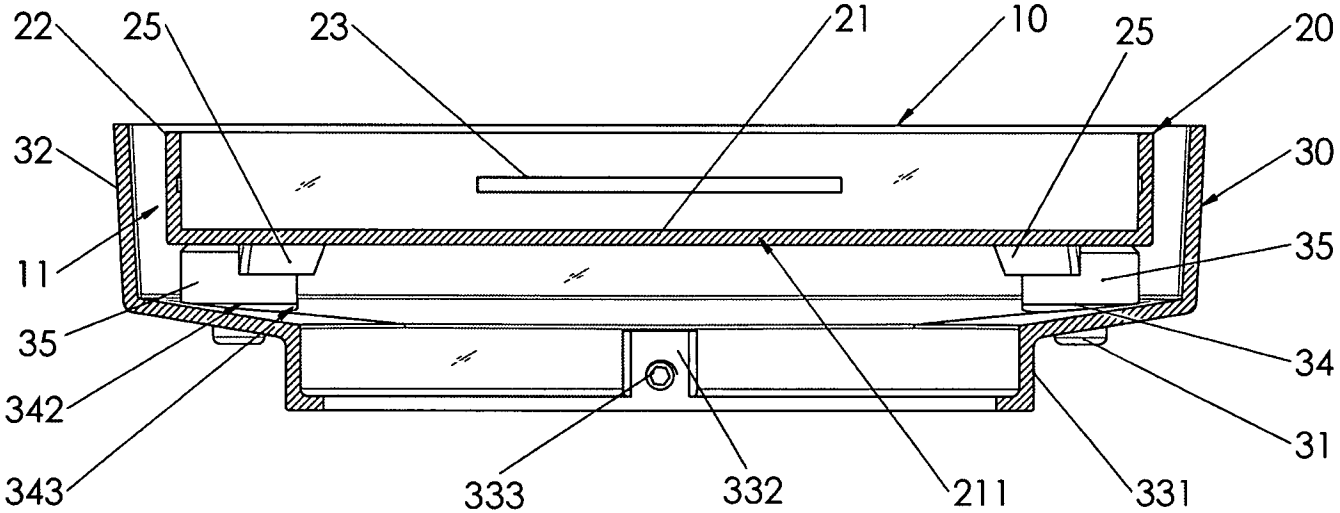
FIG. 4 is cross-sectional view A-A of the present invention

FIG. 4 is a cross-section view through the drain (10) assembly showing how the detachable insert (20) rests upon the support posts (35) which, in turn, rest upon the support post footings (34). FIG. 4 also shows the support post footing (34) having a horizontal top surface (342) so that the support post (35) rests squarely upon the support post footing (34). FIG. 4 also shows the support post footing (34) having a downward sloping bottom surface (343) thereby allowing the support post footing to rest squarely on the bottom (31) of the base (30) while retaining its vertical orientation. FIG. 4 also shows how the drainage hole side (331) extends vertically downward from the drainage hole (33). FIG. 4 also shows the drainage channel (11) formed by the spaces between the bottom (21) of the detachable insert (20) and the bottom (31) of the base (30) and the sides (22,32) of the detachable insert (20) and the base (30) respectively. FIG. 4 also shows the metal tab (332) with the set screw (333) screwed in.

Figure 7:
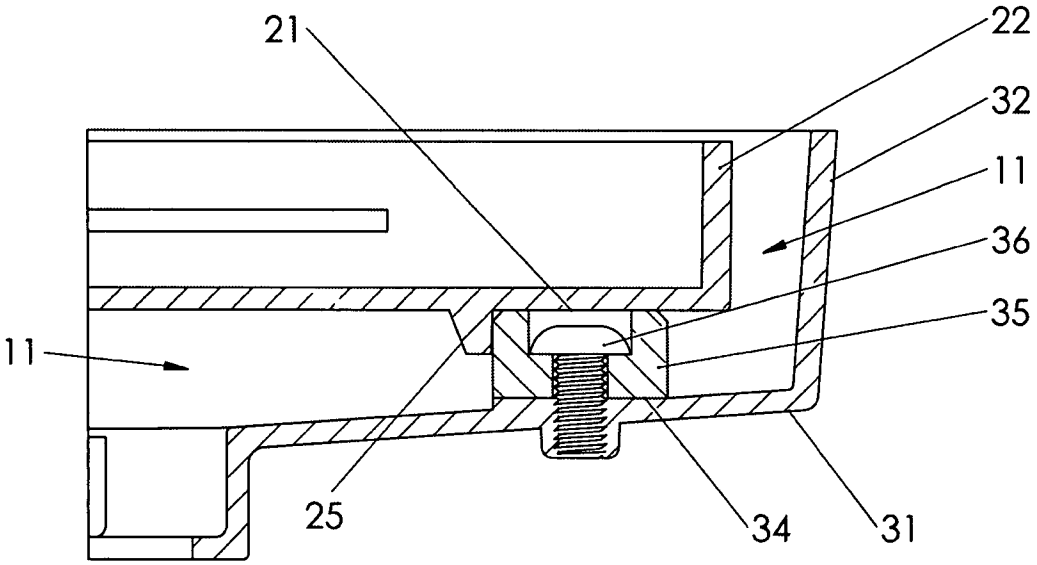
FIG. 7 is cross-sectional view C-C of the present invention
Figure 16:
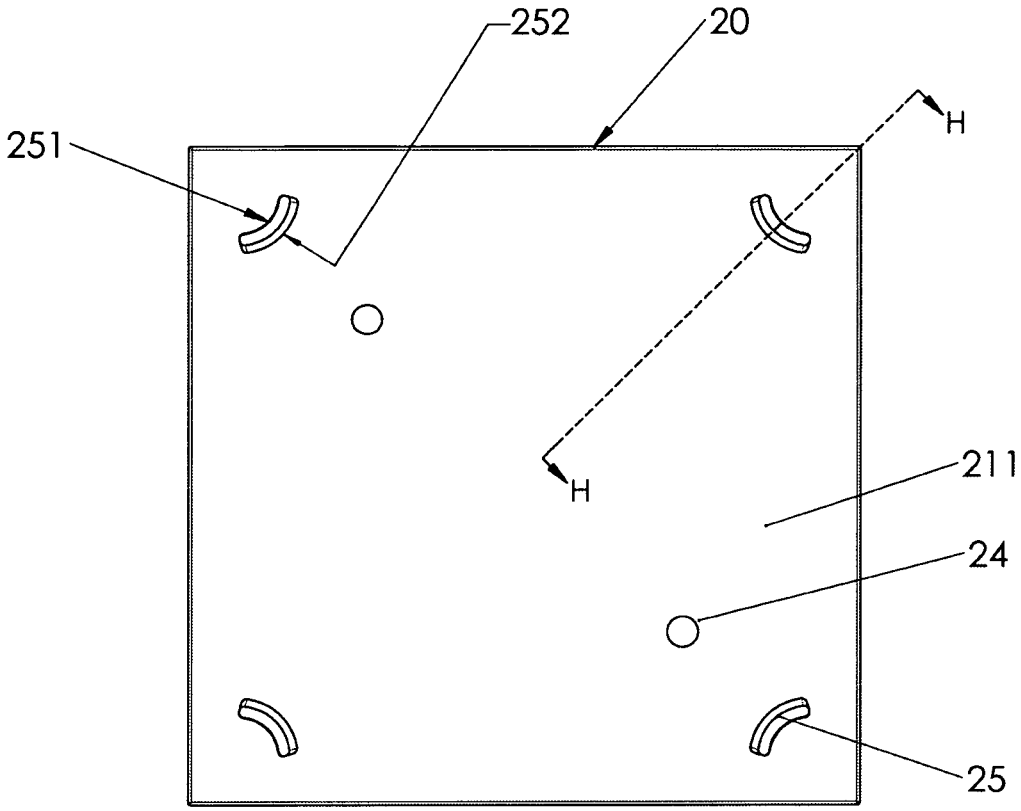
FIG. 16 is a bottom plan view of the detachable insert

Finally FIG. 4 shows two of the four fastening wedges (25) extending vertically downward from the underside (211) of the bottom (21) of the detachable insert (20). Each fastening wedge (25) is a segment of a cylindrical shell having an inner surface (251) and an outer surface (252) and typically comprised of the same material as the bottom (21) of the detachable insert (20). Each fastening wedge (25) has an inner circumference equal to that of the outer circumference of the support post (35) and is positioned on the underside (211) of the bottom (21) of the detachable insert (20) so that the inner surface (251) of the fastening wedge (25) abuts firmly and securely against the side (352) of the support post (35). (The disposition of the fastening wedge (25) with respect to the support post (35) is best seen in FIG. 7; the disposition of the four fastening wedges (25) is best seen in FIG. 16.) The surface friction between the fastening wedge (25) and the support post (35) keeps the detachable insert (20) firmly in place and attached to the base (30) so that it does not wobble, move laterally, or tip up when the user steps on it. However, since the detachable insert (20) is held in place by surface friction, it is possible to easily remove it from the base (30) for cleaning, maintenance, repair, or accessing the drain hole (33) in the base (30).

Figure 5:
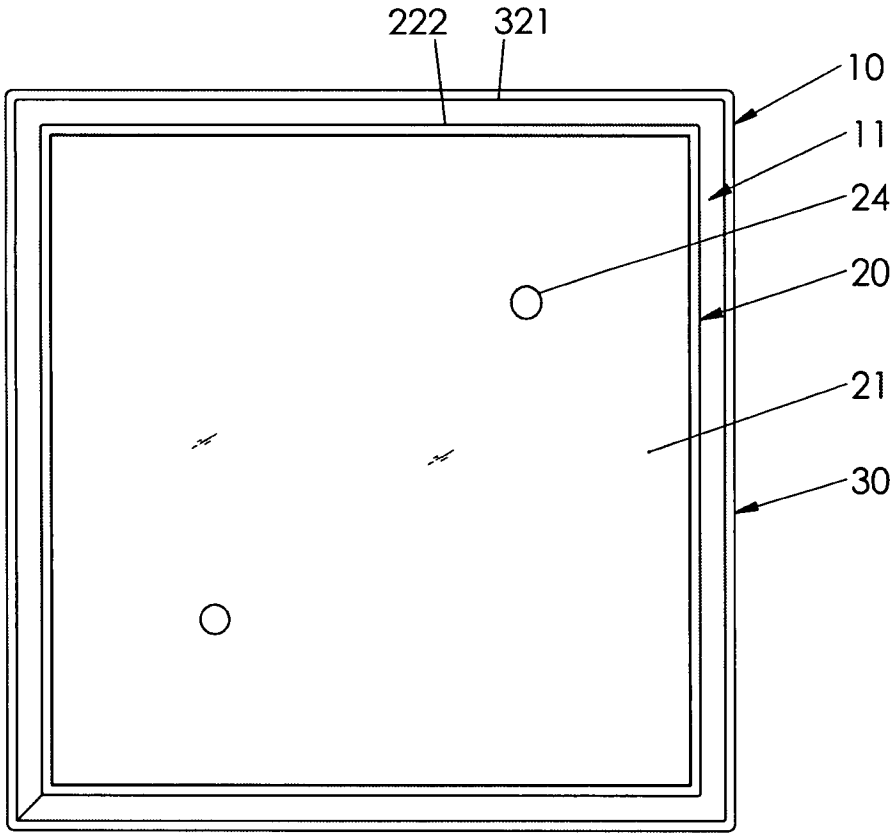
FIG. 5 is a top-plan view of the present invention

FIG. 5 is a top-plan view of the present invention showing the basic features of the drain (10) being the base (30) and the detachable insert (20). As mentioned previously, the linear dimensions of the detachable insert (20) are slightly smaller than those of the base (30) thereby creating a channel (11) between the inside face of the base side (321) and the outside face of the detachable insert side (222). The drainage holes (24) located in the bottom (21) of the detachable insert (20) permit any water trapped in the detachable insert (20) and under any tile inserted therein to drain into the channel (11) between the underside (211) of the bottom (21) of the detachable insert (20) and the bottom (31) of the base (30). The drain holes (24) can also be positioned so that any water trapped in the detachable insert (20) and under any tile inserted therein can drain directly into the drainage hole (33) as shown in FIG. 6.

Figure 6:
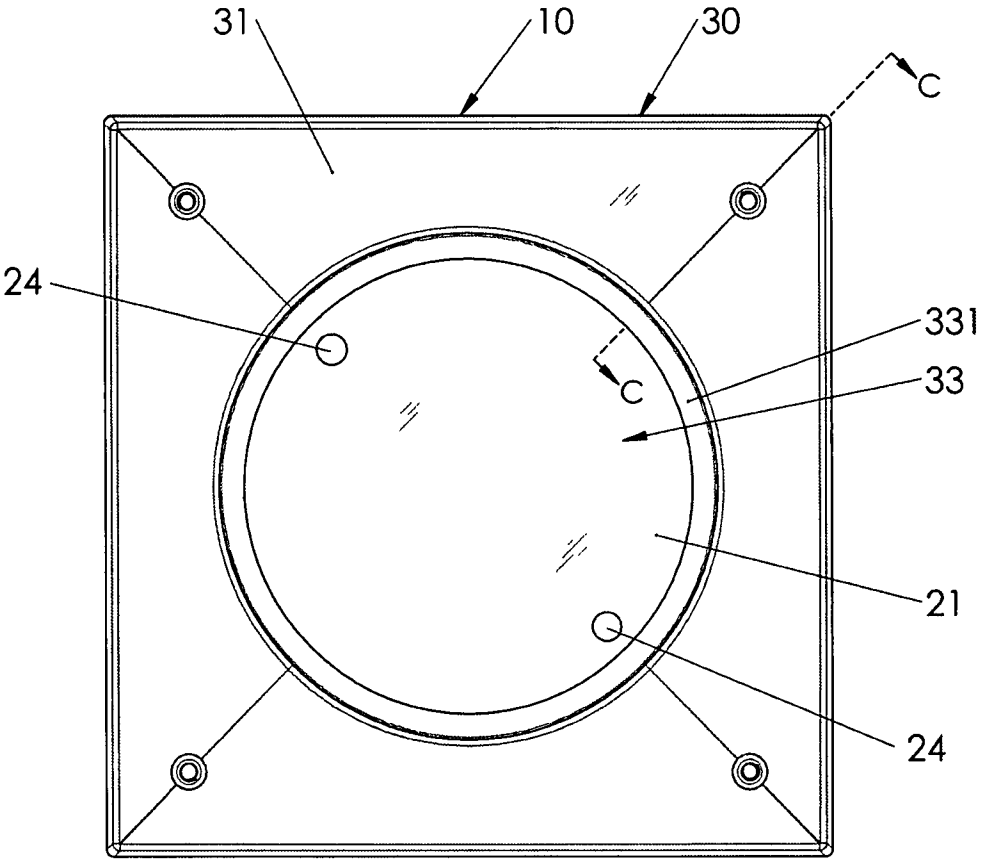
FIG. 6 is a bottom-plan view of the present invention

FIG. 6 is a bottom-plan view of the present invention showing the drain (10) in an assembled configuration. FIG. 6 shows the drain hole (33) in the bottom (31) of the base (30) with its sides (331) extending vertically downward. This bottom view shows the drain holes (24) in the bottom (21) of the detachable insert (20) positioned directly over the drain hole (33) in the bottom (31) of the base (30) so as to permit any water trapped in the detachable insert (20) and under any tile inserted therein to drain directly into the drainage hole (33).

FIG. 7 is cross-sectional view C-C of the present invention as depicted in FIG. 6. FIG. 7 shows the channel (11) created by the gap between the sides (22,32) and the bottoms (21,31) of the detachable insert (20) and the base (30). FIG. 7 also shows the fastening wedge (25) flush against the support post (35) and how the underside (211) of the bottom (21) of the detachable insert (20) rests squarely on the support post (35). Finally, FIG. 7 shows how the screw (36) attaches the support post (35) to the support post footing (34) and thereby, the base (30). The surface friction between the fastening wedge (25) and the support post (35) keeps the detachable insert (20) firmly in place and attached to the base (30) so that it does not wobble, move laterally, or tip up when the user steps on it. However, since the detachable insert (20) is held in place by surface friction, it is possible to easily remove it from the base (30) for cleaning, maintenance, repair, or accessing the drain hole (33) in the base (30).

Figure 8:
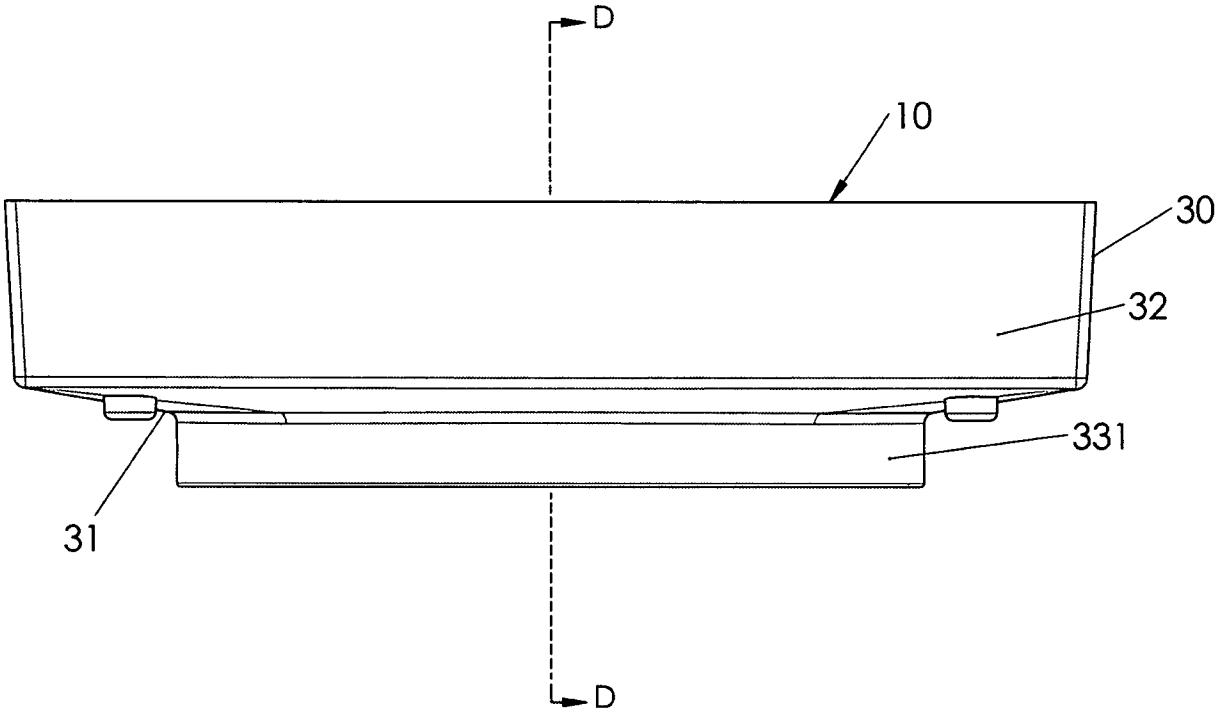
FIG. 8 is a front view of the base of present invention

FIG. 8 is a front view of the base (30) of present invention which shows how the bottom (31) of the base (30) slopes downward to intersect with a cylindrical drainage-hole side (331) which extends perpendicularly downward from the edges of the drainage hole (33).

Figure 9:
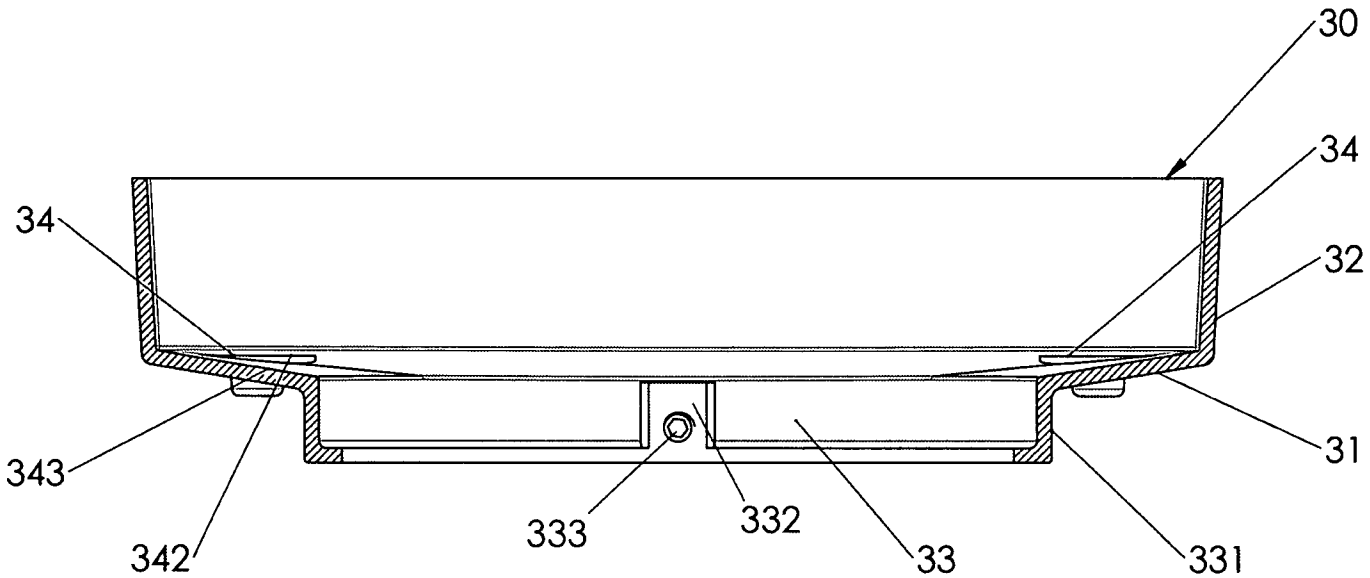
FIG. 9 is cross-sectional view D-D of the base of the present invention

FIG. 9 is cross-sectional view D-D of the base of the present invention (please refer to FIG. 8) showing the support post footings (34) with a horizontal top surface (342) so that the support post (35) (not shown in this Figure) rests squarely upon the support post footing (34). FIG. 9 also shows the support post footing (34) having a downward sloping bottom surface (343) thereby allowing the support post footing (34) to rest squarely on the downward sloping bottom (31) of the base (30) while retaining its vertical orientation and its flat, horizontal top surface (342). In this configuration, the support post footing (34) can be cast separately from the bottom (31) of the base (30) or uniformly cast with the bottom (31) and/or the base (30). FIG. 9 also shows how the drainage-hole side (331) extends vertically downward from the bottom (31) of the base (30). FIG. 9 also shows one of the two metal tabs (332) positioned opposite each other on the drainage-hole side (331) to permit attaching the drain assembly (10) to a waste water pipe (not shown) with set screws (333) passing through the waste water pipe and screwing into the metal tabs (332). The metal tabs (332) are typically shaped like a truncated pyramid and protrude perpendicularly from the drainage-hole side (331) into the drainage hole (33). The metal tabs (332) with the locking set screws (333) permit the user to removably attach the drain assembly (10) to the waste water drain pipe (not shown). The set screws (333) are accessible from the throat of the waste water drain pipe thereby allowing for easy removal of the base (30) should the metal or metal finish of the base (30) be damaged or tarnished.

Figure 10:
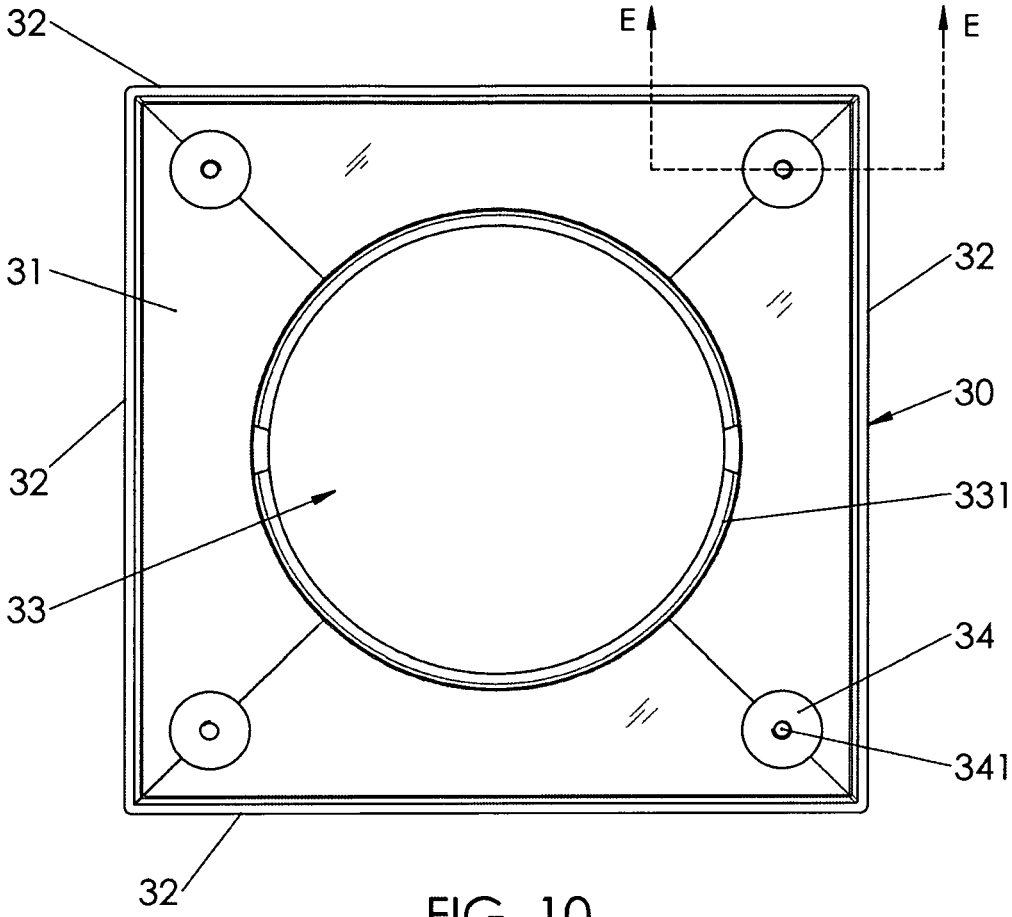
FIG. 10 is a top-plan view of the base of the present invention

FIG. 10 is a top-plan view of the base (30) of the present invention showing the generally rectangular and downward sloping bottom (31) with four sides (32) extending vertically upward from the outer extremity (311) of the bottom (31). The bottom (31) slopes downward inwardly ending in a circular drainage hole (33) in the center; the drainage hole (33) has a cylindrical side (331) extending vertically downward from its edges. FIG. 10 also shows the four support post footings (34) located at the outermost corners of the bottom (31) of the base (30) each with a hole (341) drilled through its center.

Figure 11:
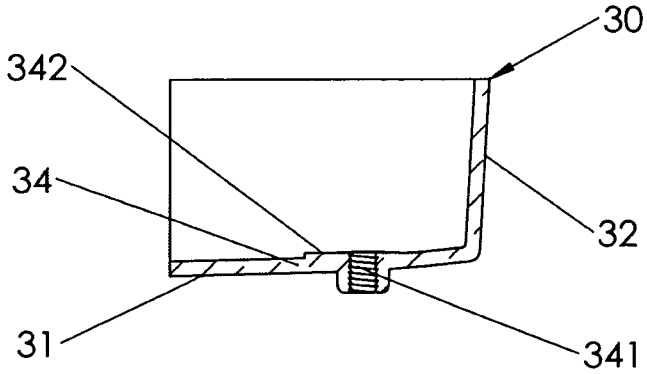
FIG. 11 is cross-sectional view E-E of the present invention

FIG. 11 is cross-sectional view E-E (please refer to FIG. 10) showing a detail view of a support post footing (34) uniformly cast with the bottom (31) and sides (32) of the base (30). The support post footing top surface (342) is horizontally aligned to permit the support post (35) (not shown in this FIG. 11) to rest squarely upon the support post footing (34). FIG. 11 also shows how the support post footing hole (341) is countersunk into the support post footing (34) to accommodate a screw (36) (not shown in this FIG. 11).

Figure 12:
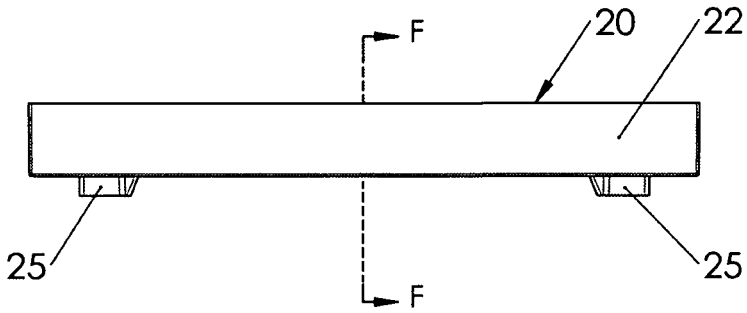
FIG. 12 is a side view of the detachable insert
Figure 13:
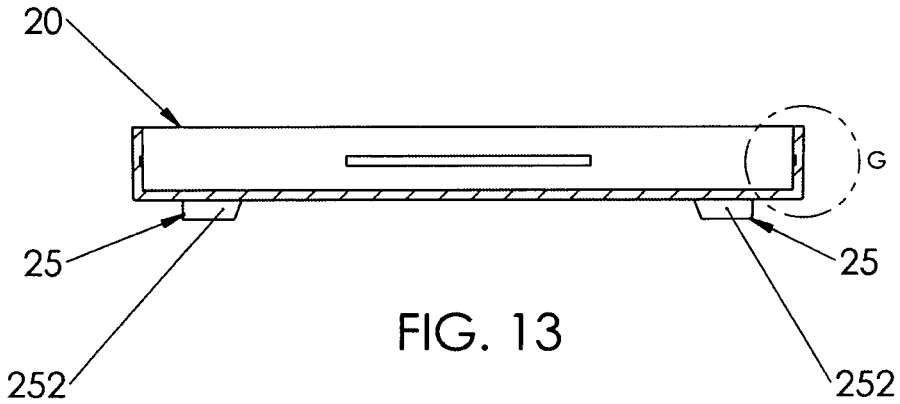
FIG. 13 is cross-sectional view F-F of the detachable insert
Figure 14:
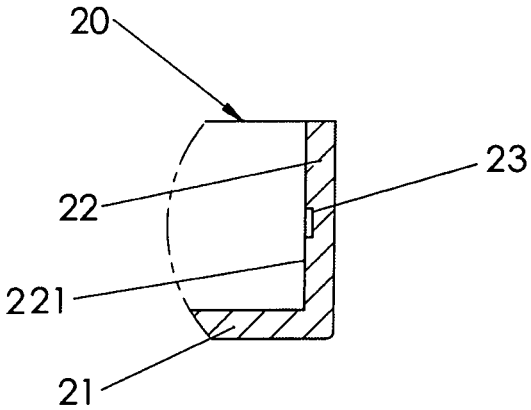
FIG. 14 is a view of detail G of the detachable insert

FIG. 12 is a side view of the detachable insert (20) showing a side and two securing wedges (25). FIG. 13 is cross-sectional view D-D through the detachable insert (20) showing a better view of the outer surfaces (252) of the securing wedges (25). As mentioned above, the surface friction between the fastening wedge (25) and the support post (35) keeps the detachable insert (20) firmly in place and attached to the base (30) so that it does not wobble, move laterally, or tip up when the user steps on it. FIG. 14 is a view of detail G of the detachable insert. This detail shows the placement of the horizontal groove (23) which is centered on the inside face (221) of each side (22) of the detachable insert (20). The groove (23) may be cast when the sides (22) are formed or they may be machined or gouged out after the sides (22) have been cast. Each groove (23) extends inwardly into the inside face (221) to facilitate securing grout that is placed around a decorative tile placed into the detachable insert (20).

Figure 15:
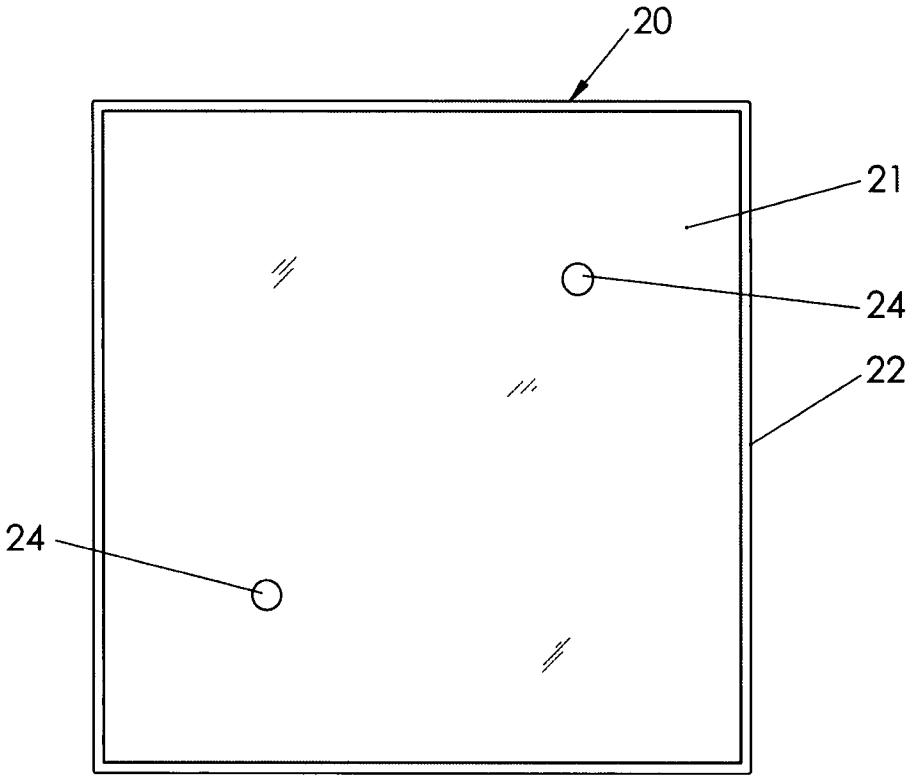
FIG. 15 is a top plan view of the detachable insert

FIG. 15 is a top plan view of the detachable insert (20) showing the basic features of the detachable insert (20): the bottom (21), the four sides (22) extending vertically upward from the outer edges of the bottom (21), and the two drainage holes (24) generally located in the center of the bottom (21).

FIG. 16 is a bottom plan view of the detachable insert (20) showing the four cylindrical-section securing wedges (25) extending vertically downward from the underside (211) of the bottom (21) of the detachable insert (20). Each securing wedge (25) has an inner surface (251) and an outer surface (252) with the diameter of the inner surface (251) equivalent to the diameter of the securing post (35) (not shown in this FIG. 16) so that the inner surface (251) of the securing wedge (25) rests firmly and securely against the side (351) of the securing post (35) thereby preventing vertical lateral movement of the detachable insert (20) but permitting relatively easy removal for cleaning, maintenance, replacement of the decorative tiles inserted therein, as well as any other reason for removing the detachable insert.

Figure 17:
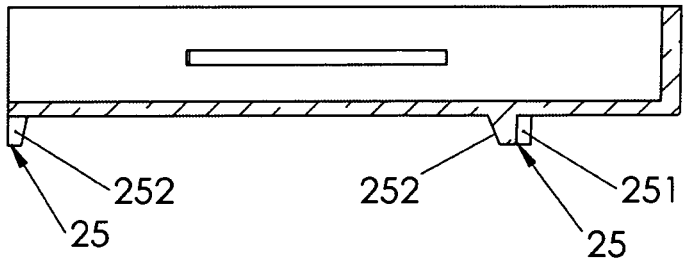
FIG. 17 is cross-sectional view H-H of the detachable insert

FIG. 17 is cross-sectional view F-F (please refer to FIG. 16) through a portion of the detachable insert (20) and one securing wedge (25) showing the disposition of the inner surface (251) and the outer surface (252) of the securing wedge (25).

Figure 20:
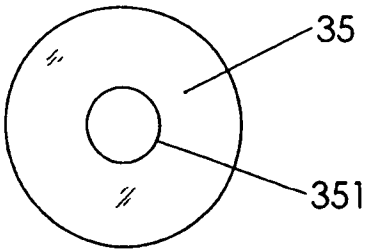
FIG. 20 is a bottom plan view of the support post
Figure 21:
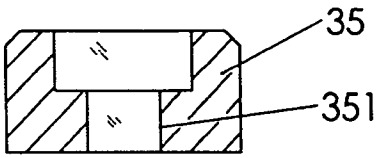
FIG. 21 is cross-sectional view K-K of the support post
Figure 18:
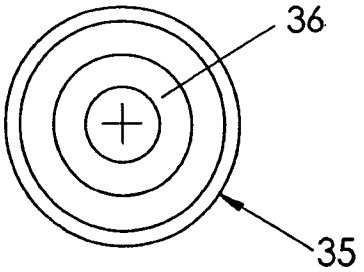
FIG. 18 is a top plan view of the support post
Figure 19:
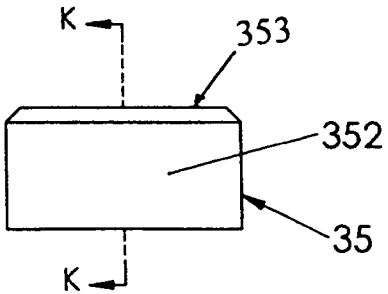
FIG. 19 is a side view of the support post

FIG. 18 is a top plan view of the support post (35) with the screw (36) inserted therein. FIG. 19 is a side view of the support post (35) showing the support post top surface (353) which is the surface that the underside (211) of the bottom (21) of the detachable insert (20) rests and the support post side (352) which is the surface which would abut firmly and securely against the inner surface (251) of the securing wedge (25) (not shown in this FIG. 19). FIG. 20 is a bottom plan view of the support post (35) showing the support post hole (351). FIG. 21 is cross-sectional view K-K (please refer to FIG. 19) through the support post (35) showing how a screw (36) (not shown in this FIG. 21) would be positioned in the support post hole (351) which is countersunk through the center of the support post (35).

Operation—Preferred Embodiment

To operate the preferred embodiment of the drain (10), the user simply places the detachable insert (20) into the base (30) by aligning the securing wedges (25) on the underside (211) of the detachable insert (20) over the support posts (35) which have been secured to the support post footings (34), and thereby the base (30) by screws (36). The user then positions the inner surfaces (251) of the securing wedges (25) directly against the sides (351) of the support posts (35) and presses the detachable insert (20) downward into the base (30). Since the diameter of the inner surface (251) of the securing wedges (25) is the same as the diameter of the support post, the inner surface (251) will be in direct contact with the side (351) of the support post (35). The user then slides the securing wedge (25) along the inside of the support post (35) until the underside (211) of the bottom (21) of the detachable insert (20) rests upon the top surface of the support post (353). Since the inner surface (251) of the securing wedge (25) is flush against the side (351) of the support post (35), there is not lateral movement of the detachable insert (20) while it is set in place in the base (30). Since the underside (211) of the bottom (21) of the detachable insert (20) rests firmly upon the top surface (353) of the support post (35) and the support post (35) is firmly attached to the base (30), there is no movement in the vertical plane either.

To remove the detachable insert from the base, the user simply grabs the detachable insert (20) by its sides (22) between the thumb and fingers and lifts the detachable insert (20) upward by sliding the securing wedges (25) upward over the support posts (35). The user then has access to the base (30) for maintenance, cleaning, and the like.

Conclusion, Ramifications, and Scope

The present invention as described herein has been designed to address the problems found in the prior art. Accordingly, the objects and advantages of the present invention are:

To provide a floor drain with a detachable cover that is securely attached to its foundation but easily removed so as to permit easy inspection, cleaning, or other such routine maintenance of the drain.

To provide a floor drain with a detachable cover that affords the user an unlimited number of options as to materials to place in the cover.

To provide a floor drain with a detachable cover that is simple in design, easy and inexpensive to manufacture, and reasonable in cost to the consumer.

To provide a floor drain with a detachable cover that is securely attached to its foundation so that it does not move, slip, or slide when the user steps on it.

To provide a replaceable (as opposed to a permanently embedded) metal base for a floor drain in the event of damage to the metal base itself or damage to the finish of the metal base.

We claim:

1. A floor drain with a detachable cover comprising:

a. a generally rectangular base having a downwardly sloping bottom and four sides extending vertically upward from said bottom's outer edges, said bottom having:

(1) a drainage hole positioned in its center with a cylindrical side extending vertically downward from said hole's edges, (2) four truncated cylindrical support post footings positioned near each of said bottom's outer corners and having threaded holes centered and countersunk therein, (3) four cylindrical support posts equal in diameter to said support post footings, said support posts having threaded holes equal in diameter to that of said holes in said footings, centered and countersunk therein, with said support post firmly attached to said support post footing by a screw; and b. a generally rectangular detachable insert with smaller linear dimensions than those of said base and having a horizontal bottom that rests upon said support posts so as to create a horizontal channel between said bottom of said base and said bottom of said detachable insert, said bottom of said detachable insert having four sides extending vertically upward from said bottom's outer edges so as to be equal in height to said sides of said base and creating a vertical channel between said sides of said base and said sides of said detachable insert, said bottom having:

(1) one or more drain holes positioned at or near the center of said bottom, (2) four cylindrically-segmented securing wedges extending vertically downward from said bottom's underside, each of said securing wedges having a concave inner surface facing said bottom's outer corners, a diameter equal to that of said support posts, and positioned on said underside so that said inner surface of each securing wedge is directly over said side of a corresponding support post thereby creating surface-to-surface contact between said four inner surfaces and said four sides of said support posts when said detachable insert is inserted into said base.

2. The floor drain according to claim 1 wherein said support post footing and said base bottom are uniformly cast.

3. The floor drain according to claim 1 wherein said support post footing and said base bottom are cast separately whereby said support post footing has an angled bottom surface with a slope equal to that of said base bottom thereby ensuring that said support post's top surface is horizontal.

4. The floor drain according to claim 1 further comprising two solid truncated pyramidal metal tabs extending perpendicularly from said cylindrical side, said tabs capable of receiving set screws to attach said drain to a waste water pipe thereby permitting removal of said base from said waste water pipe in the event of damage to said base.

5. The floor drain according to claim 1 further comprising one or more horizontal grooves each separately cast or gouged into and centered on one or more inner surfaces of one or more of said detachable insert's sides.

6. The floor drain according to claim 4 wherein said support post footing and said base bottom are uniformly cast.

7. The floor drain according to claim 4 wherein said support post footing and said base bottom are cast separately whereby said support post footing has an angled bottom surface with a slope equal to that of said base bottom thereby ensuring that said support post's top surface is horizontal.

8. The floor drain according to claim 5 wherein said support post footing and said base bottom are uniformly cast.

9. The floor drain according to claim 5 wherein said support post footing and said base bottom are cast separately whereby said support post footing has an angled bottom surface with a slope equal to that of said base bottom thereby ensuring that said support post's top surface is horizontal.

10. A floor drain with a detachable cover comprising:

a. a base having a downwardly sloping bottom and sides extending vertically upward from said bottom's outer edges, said bottom having:
   (1) a drainage hole positioned in its center with a cylindrical side extending vertically downward from said hole's edges,
   (2) at least two truncated cylindrical support post footings positioned near each of said bottom's outer edges and having threaded holes centered and countersunk therein,
   (3) an equal number of support posts equal in diameter to said support post footings, said support posts having threaded holes equal in diameter to that of said holes in said footings, centered and countersunk therein, with said support post firmly attached to said support post footing by a screw; and b. a generally detachable insert similar in shape to said base but with smaller linear dimensions than those of said base and having a horizontal bottom that rests upon said support posts so as to create a horizontal channel between said bottom of said base and said bottom of said detachable insert, said bottom of said detachable insert having sides extending vertically upward from said bottom's outer edges so as to be equal in height to said sides of said base and creating a vertical channel between said sides of said base and said sides of said detachable insert, said bottom having:
   (1) one or more drain holes positioned at or near the center of said bottom,
   (2) a number of cylindrically-segmented equal to that of said support posts and said support post footings, said securing wedges extending vertically downward from said bottom's underside, each of said securing wedges having a concave inner surface facing said bottom's outer corners, a diameter equal to that of said support posts, and positioned on said underside so that said inner surface of each securing wedge is directly over said side of a corresponding support post thereby creating surface-to-surface contact between said four inner surfaces and said four sides of said support posts when said detachable insert is inserted into said base.

11. The floor drain according to claim 10 wherein said support post footing and said base bottom are uniformly cast.

12. The floor drain according to claim 10 wherein said support post footing and said base bottom are cast separately whereby said support post footing has an angled bottom surface with a slope equal to that of said base bottom thereby ensuring that said support post's top surface is horizontal.

13. The floor drain according to claim 10 further comprising two solid truncated pyramidal metal tabs extending perpendicularly from said cylindrical side, said tabs capable of receiving set screws to attach said drain to a waste water pipe thereby permitting removal of said base from said waste water pipe in the event of damage to said base.

14. The floor drain according to claim 10 further comprising one or more horizontal grooves each separately cast or gouged into and centered on one or more inner surfaces of one or more of said detachable insert's sides.

15. The floor drain according to claim 13 wherein said support post footing and said base bottom are uniformly cast.

16. The floor drain according to claim 13 wherein said support post footing and said base bottom are cast separately whereby said support post footing has an angled bottom surface with a slope equal to that of said base bottom thereby ensuring that said support post's top surface is horizontal.

17. The floor drain according to claim 14 wherein said support post footing and said base bottom are uniformly cast.

18. The floor drain according to claim 14 wherein said support post footing and said base bottom are cast separately whereby said support post footing has an angled bottom surface with a slope equal to that of said base bottom thereby ensuring that said support post's top surface is horizontal.

19. A method for using said floor drain described herein comprising the steps of:

a. aligning all four of said securing wedges on said underside of said detachable insert over said corresponding support posts which have been secured to said support post footings and thereby to said base,
b. positioning said inner surfaces of said securing wedges directly against said sides of said support posts; and
c. pressing said detachable insert downward into said base so that said securing wedges slide over said support posts until said securing wedge hits said bottom of said base, constantly keeping said inner surfaces of all four of said securing wedges firmly in surface contact with said outer sides of said support posts.

20. The method according to claim 13 further comprising the steps of a. grabbing said detachable insert by its said sides; and
b. sliding said securing wedges upward over said support posts.

* * * * *